US010125756B2

(12) United States Patent
Harte et al.

(10) Patent No.: US 10,125,756 B2
(45) Date of Patent: Nov. 13, 2018

(54) SYSTEM AND METHOD FOR REDUCING AT LEAST ONE OF AIRFLOW TURBULENCE AND PRESSURE FLUCTUATION PROXIMATE A VALVE

(71) Applicant: Bendix Commercial Vehicle Systems LLC, Elyria, OH (US)

(72) Inventors: Shane A Harte, Westlake, OH (US); Edward F Hoban, Lakewood, OH (US); Gene E. Gilbert, Elyria, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 645 days.

(21) Appl. No.: 14/579,015

(22) Filed: Dec. 22, 2014

(65) Prior Publication Data

US 2016/0177936 A1 Jun. 23, 2016

(51) Int. Cl.
*F04B 39/00* (2006.01)
*F04B 53/12* (2006.01)
(Continued)

(52) U.S. Cl.
CPC ..... *F04B 39/0061* (2013.01); *F04B 39/0055* (2013.01); *F04B 39/064* (2013.01); *F04B 39/125* (2013.01); *F04B 53/124* (2013.01)

(58) Field of Classification Search
CPC .... F04B 39/06; F04B 39/064; F04B 39/0027; F04B 39/0055; F04B 39/0061;
(Continued)

(56) References Cited

U.S. PATENT DOCUMENTS 2,043,849 A 6/1936 Bixler
3,785,453 A * 1/1974 Buonocore ..... F04B 39/0055 181/211
(Continued)

FOREIGN PATENT DOCUMENTS

DE 2826744 A1 1/1980
DE 19535079 A1 4/1996
(Continued)

OTHER PUBLICATIONS

Author: Bendix Title: Bendix BA-921 compressor: standard and closed room Published date (mm/yyyy): Oct. 2007 Date accessed (mm/dd/yyyy): Jun. 19, 2017 Link: https://www.manualslib.com/manual/392595/Bendix-Ba-921-Compressor-Std-Closed-Room.html.*
(Continued)

*Primary Examiner* — Kenneth J Hansen
*Assistant Examiner* — Chirag Jariwala
(74) *Attorney, Agent, or Firm* — Brian E. Kondas; Cheryl L. Greenly; Eugene E. Clair

(57) ABSTRACT

A baffle, for directing air within a compressor head, includes a first leg extending along a first direction, positioned proximate to a first valve of the compressor head, and a second leg extending along the first direction and substantially parallel to the first leg, positioned proximate to a second valve of the compressor head. A first portion of air from a first side of the first leg is communicated to a second side of the first leg beyond an end of the first leg. An aperture in the first leg communicates a second portion of the air from the first side of the first leg to the second side of the first leg. A turbulence and/or pressure fluctuation proximate the first valve is reduced by communicating the second portion of the air from the first side to the second side of the first leg.

18 Claims, 5 Drawing Sheets

(51) Int. Cl.
*F04B 39/06* (2006.01)
*F04B 39/12* (2006.01)

(58) Field of Classification Search
CPC ..... F04B 39/12; F04B 39/125; F04B 53/007; F04B 53/08; F04B 53/16; F04B 53/12; F04B 53/124; F04B 11/0091
USPC ..... 417/53, 312, 313, 540, 559, 569; 137/339; 181/211, 212, 264–283, 403
See application file for complete search history.

(56) References Cited

U.S. PATENT DOCUMENTS

| | | | | |
|---|---|---|---|---|
| 5,073,146 | A | 12/1991 | Beck | |
| 5,503,537 | A | 4/1996 | Schlossarczyk et al. | |
| 5,722,818 | A | 3/1998 | Ohta et al. | |
| 6,053,713 | A | 4/2000 | Brown | |
| 6,113,369 | A | 9/2000 | Selway | |
| 6,116,874 | A * | 9/2000 | Nation | F04B 39/064 137/512 |
| 6,206,655 | B1 | 3/2001 | Tanaka et al. | |
| 6,382,931 | B1 * | 5/2002 | Czabala | F04C 29/065 181/229 |
| 6,599,101 | B2 | 7/2003 | Matsuura et al. | |
| 8,337,177 | B2 * | 12/2012 | Mezza | F04B 39/06 417/438 |
| 2011/0070101 | A1 | 3/2011 | Mezza et al. | |
| 2013/0087233 | A1 | 4/2013 | Cesak et al. | |

FOREIGN PATENT DOCUMENTS

| | | | |
|---|---|---|---|
| EP | 0893602 | A2 | 1/1999 |
| EP | 0893602 | A3 | 9/1999 |
| JP | H11218079 | A | 8/1999 |
| WO | 2009017325 | A1 | 2/2009 |

OTHER PUBLICATIONS

Author: Accupart Title: KNO61 K13CP1-CR, Cooling Plate, BA921 Closed Room Published date: Not available Date accessed (mm/dd/yyyy): Jun. 19, 2017 Link: http://www.accupart.com/kno61k13cp1-cr-cooling-plate-ba921-closed-room/.*

Notification of Transmittal of the International Search Report and the Written Opinion of the International Searching Authority, or the Declaration for counterpart International Appln. No. PCT/US2015/065152, 1 page, dated Mar. 30, 2016.

International Search Report for counterpart International Appln. No. PCT/US2015/065152, 7 pages, dated Mar. 30, 2016.

Written Opinion of the International Searching Authority for counterpart International Appln. No. PCT/US2015/065152, 9 pages, dated Mar. 30, 2016.

* cited by examiner

SYSTEM AND METHOD FOR REDUCING AT LEAST ONE OF AIRFLOW TURBULENCE AND PRESSURE FLUCTUATION PROXIMATE A VALVE

BACKGROUND

The present invention relates to a compressor head. It finds particular application in conjunction with a compressor head including a cooling plate and two discharge reed valves, which discharge air from an associated compressor to the compressor head, and will be described with particular reference thereto. It will be appreciated, however, that the invention is also amenable to other applications.

Some compressor heads include a cooling plate for extending a path along which air is directed to pass by a cooling wall adjacent to a cooling channel as the air travels through an air channel after being received in the compressor head. For example, the cooling plate directs the air along a bottom portion of the cooling wall in a bottom portion of the air channel before passing through an aperture in the cooling plate and being directed along a top portion of the cooling wall in a top portion of the air channel. Extending the path along the cooling wall serves to facilitate further temperature reduction of the air before exiting the air channel.

The reed valves are typically positioned in the same portion of the compressor head (i.e., on a same side of the cooling plate), but on different sides (e.g., left side and right side) of the compressor head. More specifically, although both of the reed valves are in the same portion (e.g., a bottom portion) of the compressor head, one of the reed valves is positioned on a left side of the compressor head while the other of the reed valves is positioned on a right side of the compressor head.

Although both of the reed valves are on the same side of the cooling plate, one of the reed valves is positioned relatively closer to the aperture. Air dynamics proximate to the reed valve closer to the aperture may cause flutter in that reed valve as the air is exiting the air channel. The flutter tends to cause the reed valve closer to the cooling plate aperture to prematurely fail. For example, the reed valve closer to the cooling plate aperture tends to fail before the reed valve farther from the aperture.

The present invention provides a new and improved apparatus and method which addresses the above-referenced problem.

SUMMARY

In one aspect of the present invention, it is contemplated that a baffle, for directing air within a compressor head, includes a first leg extending along a first direction, positioned proximate to a first valve of the compressor head, and a second leg extending along the first direction and substantially parallel to the first leg, positioned proximate to a second valve of the compressor head. A first portion of air from a first side of the first leg is communicated to a second side of the first leg beyond an end of the first leg. An aperture in the first communicates a second portion of the air from the first side of the first leg to the second side of the first leg. A turbulence and/or pressure fluctuation proximate the first valve is reduced by communicating the second portion of the air from the first side to the second side of the first leg.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION OF ILLUSTRATED EMBODIMENT

Figure 1:
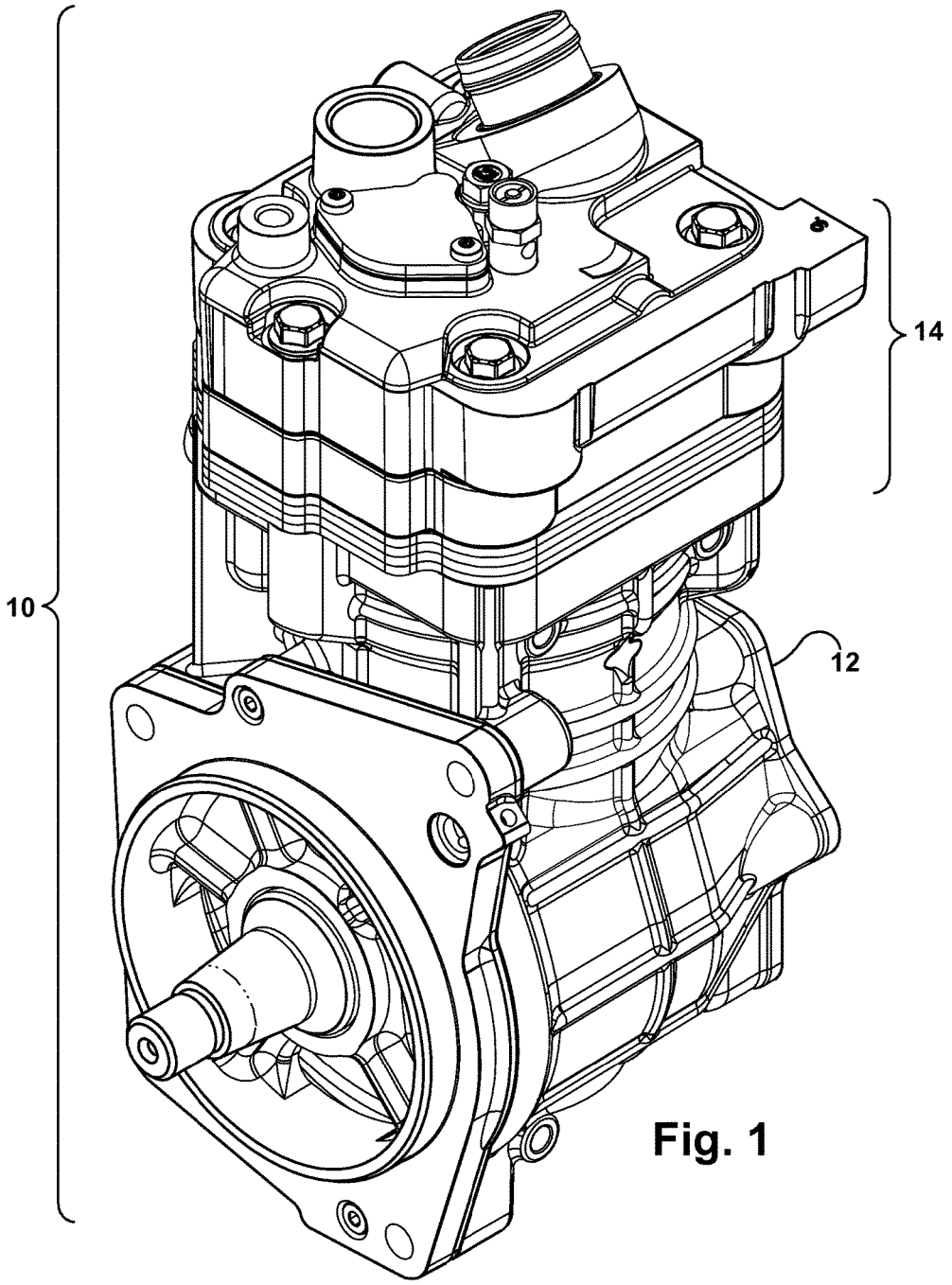
FIG. 1 illustrates an assembly including a compressor and a compressor head in accordance with one embodiment of an apparatus illustrating principles of the present invention.

With reference to FIG. 1, an assembly 10 including a compressor 12 and a compressor head 14 is illustrated in accordance with one embodiment of the present invention.

Figure 2:
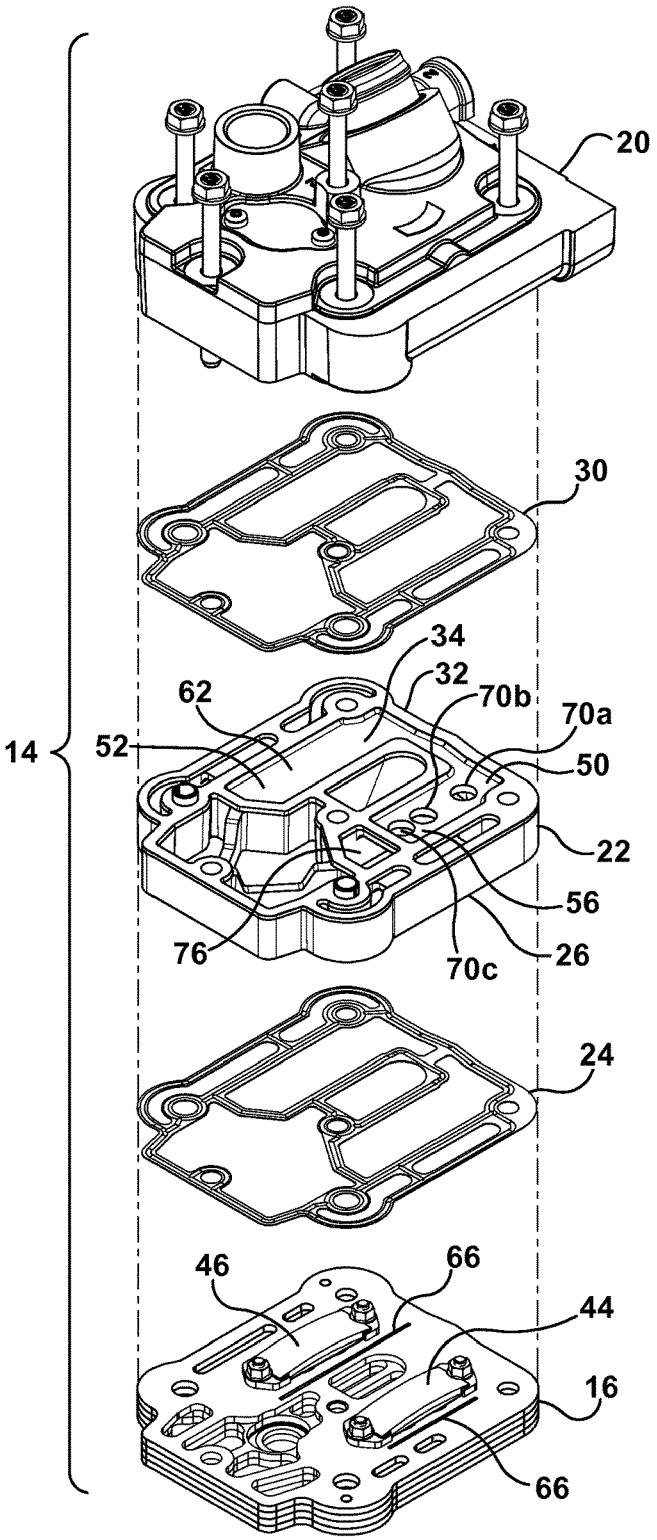
FIG. 2 illustrates an exploded view of the assembly of FIG. 1 in accordance with one embodiment of an apparatus illustrating principles of the present invention.

With reference to FIGS. 1 and 2, the compressor head 14 includes a first portion 16 (e.g., a lower portion), a second portion 20 (e.g., an upper portion), and a plate 22 positioned between the first (e.g., lower) portion 16 and the second (e.g., upper) portion 20 of the compressor head 14. A first sealing device 24 (e.g., gasket) is sealingly positioned between the first portion 16 (e.g., lower portion) of the compressor head 14 and a first face 26 (e.g., a lower face) of the plate 22. A second sealing device 30 (e.g., gasket) is sealingly positioned between the second portion 20 (e.g., upper portion) of the compressor head 14 and a second face 32 (e.g., an upper face) of the plate 22.

In the illustrated embodiment, a divider 34 (e.g., a baffle) is a part of a casting defining the plate 22. Alternatively, the divider 34 is a separate piece that is secured between the second (e.g., upper) portion 20 of the compressor head 14 and the plate 22.

Figure 3:
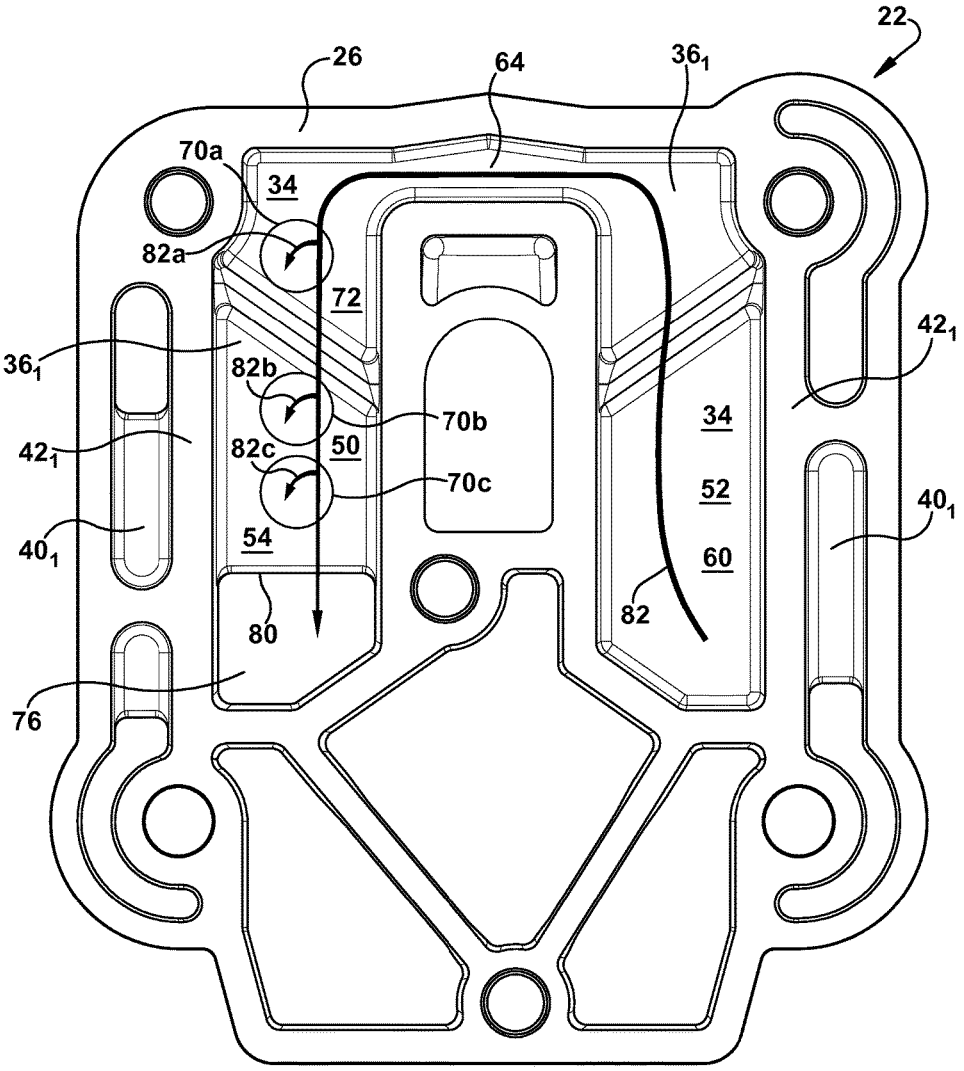
FIG. 3 illustrates a lower face of a plate of the compressor head in accordance with one embodiment of an apparatus illustrating principles of the present invention.

FIG. 3 illustrates the first face 26 (e.g., lower face) of the plate 22. When assembled with the lower portion 16 (see FIG. 2), the first face 26 (e.g., lower face) of the plate 22 cooperates with the first (e.g., lower) portion 16 (see FIG. 2) of the compressor head 14 to define a first portion $\mathbf{36}_1$ (e.g., a lower portion) of an air channel 36, and a first portion $\mathbf{40}_1$ (e.g., a lower portion) of a cooling channel 40. The first portion (e.g., lower portion) of the air channel $\mathbf{36}_1$ is adjacent the first portion (e.g., lower portion) of the cooling channel $\mathbf{40}_1$ and is separated by a first portion (e.g., lower portion) of a wall $\mathbf{42}_1$.

Figure 4:
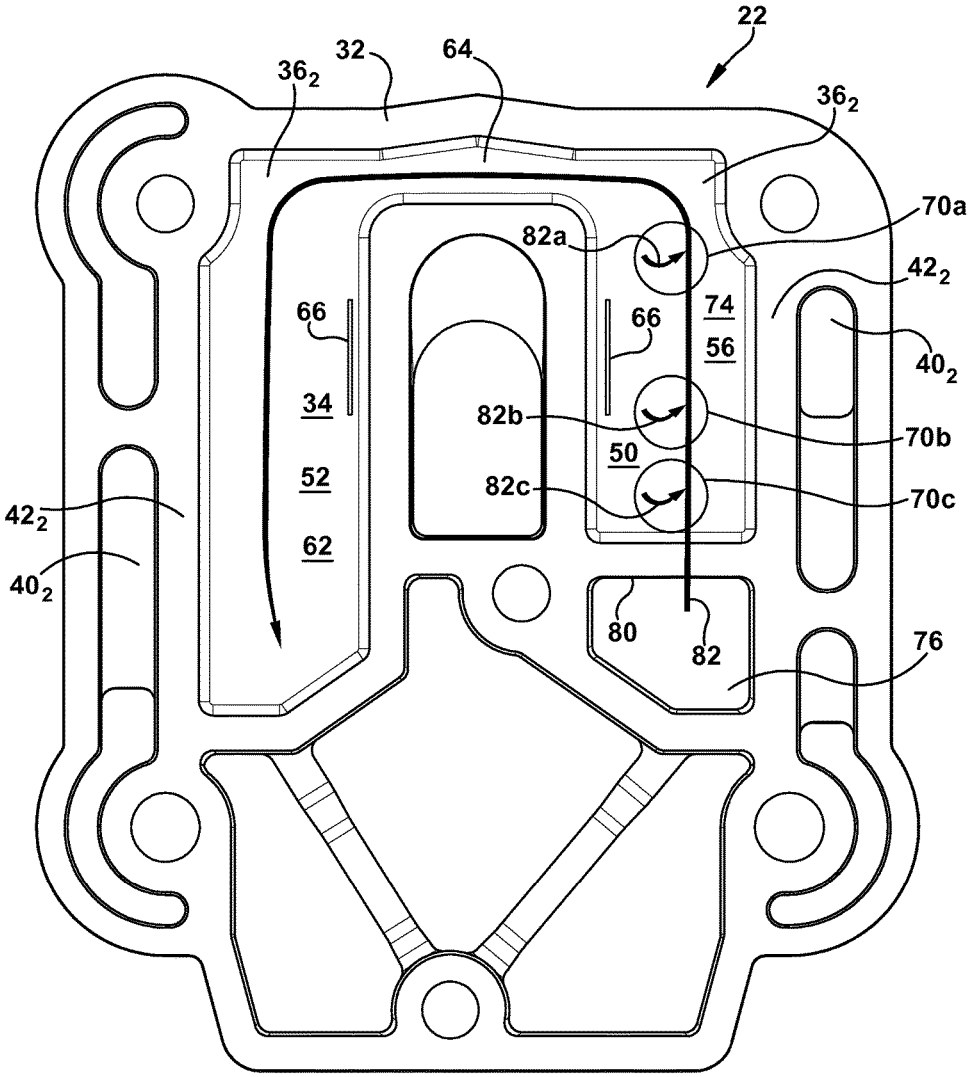
FIG. 4 illustrates an upper face of the plate of the compressor head in accordance with one embodiment of an apparatus illustrating principles of the present invention.

FIG. 4 illustrates the second face 32 (e.g., upper face) of the plate 22. When assembled with the upper portion 20 (see FIG. 2), the second face 32 (e.g., upper face) of the plate 22 cooperates with the second (e.g., upper) portion 20 (see FIG. 2) of the compressor head 14 to define a second portion $\mathbf{36}_2$ (e.g., an upper portion) of the air channel 36, and a second portion $\mathbf{40}_2$ (e.g., an upper portion) of the cooling channel 40. The second portion of the air channel $\mathbf{36}_2$ (e.g., upper portion) is adjacent the second portion (e.g., upper portion) of the cooling channel $\mathbf{40}_2$ and is separated by a second portion (e.g., upper portion) of the wall $\mathbf{42}_2$.

The divider 34 (e.g., a baffle) is positioned between the first and second portions $\mathbf{36}_1$, $\mathbf{36}_2$, respectively, of the air channel 36.

With reference to FIGS. 1 and 2, the first portion 16 (e.g., lower portion) of the compressor head 14 includes a first valve 44 and a second valve 46. In the illustrated embodiment, the first and second valves 44, 46, respectively, discharge air from the compressor 12 to the first portion $\mathbf{36}_1$ (e.g., lower portion) of the air channel 36. Therefore, the first and second valves 44, 46, respectively, may be referred to as discharge valves. In one embodiment, the first valve 44 and the second valve 46 are reed valves.

As illustrated in FIGS. 2, 3, and 4, the divider 34 is substantially U-shaped and includes a first leg 50 and a second leg 52. A first face 54 (e.g., lower face) of the first leg 50 faces toward the first valve 44; and a second face 56 (e.g., upper face) of the first leg 50 faces away from the first valve 44. A first face 60 (e.g., lower face) of the second leg 52 faces toward the second valve 46; and a second face 62 (e.g., upper face) of the second leg 52 faces away from the second valve 46.

The divider 34 also includes a central portion 64, between the first and second legs 50, 52, respectively. The first and second legs 50, 52, respectively, include respective longitudinal axes that extend along a first direction 66 and are substantially parallel with each other. In addition, in one embodiment, the longitudinal axes along the first direction 66 of first and second legs 50, 52, respectively, are substantially parallel with respective longitudinal axes of the first and second valves 44, 46 (e.g., reed valves), which also extend along the first direction 66. The first leg 50 is positioned proximate to the first valve 44. The second leg 52 is positioned proximate to the second valve 46. For example, the first leg 50 is positioned "in-line" with the first valve 44. In other words, as illustrated in FIG. 2, the first leg 50 is positioned above the first valve 44. In other orientations, it may also be stated that the first leg 50 is positioned across from the first valve 44.

At least one (1) divider aperture 70*a* (e.g., a baffle aperture) is included in the divider 34. In the illustrated embodiment, three (3) divider apertures 70*a*, 70*b*, 70*c* are included in the divider 34. For purposes of discussion, divider apertures 70*a*, 70*b*, 70*c* are referred to as first, second, and third divider apertures, respectively. Alternatively, one (1) of the divider apertures 70*a*, 70*b*, 70*c* may simply be referred to as a divider aperture, while the other two (2) of the divider apertures 70*a*, 70*b*, 70*c* may be referred to as at least one additional divider aperture (e.g., first and second additional divider apertures). The divider apertures 70*a*, 70*b*, 70*c* are collectively referenced as 70. Although three (3) divider apertures 70*a*, 70*b*, 70*c* are illustrated, it is to be understood that any number of divider apertures 70 are contemplated. The at least one divider aperture 70 passes completely through the divider 34 and provides for fluid communication between a first face 72 (e.g., a lower face) of the divider 34 and a second face 74 (e.g., an upper face) of the divider 34. Therefore, the at least one divider aperture 70 provides for fluid communication between the first portion $\mathbf{36}_1$ of the air channel 36 and the second portion $\mathbf{36}_2$ of the air channel 36.

In one embodiment, it is contemplated that each of the divider apertures 70*a*, 70*b*, 70*c* is generally aligned along the first direction 66.

In the illustrated embodiment, each of the divider apertures 70 is included in the first leg 50 of the divider 34. As discussed in more detail below, at least one (1) of the divider apertures 70 is proximate to the first valve 44. For example, at least one (1) of the divider apertures 70 is "in-line" with the first valve 44. As discussed above, the term "in-line" indicates at least one (1) of the divider apertures 70 is positioned above or across from the first valve 44. As discussed below, at least one of the divider apertures 70 is also contemplated to be before the first valve 44 along the path 82 from the second valve 46 to the first valve 44.

A plate aperture 76 is positioned in the plate 22 proximate an end 80 (e.g., an edge) of the first leg 50.

With reference to FIGS. 3 and 4, an arrow 82 illustrates an airflow path in the first and second air channel portions $\mathbf{36}_1$, $\mathbf{36}_2$, respectively, around the plate 22. The air enters the first (e.g., lower) portion of the air channel $\mathbf{36}_1$ via the first and second valves 44, 46 (see FIG. 2), respectively. Since the first valve 44 (see FIG. 2) is positioned proximate to the first leg 50, the air entering via the first valve 44 (see FIG. 2) enters the first (e.g., lower) portion of the air channel $\mathbf{36}_1$ proximate to the first leg 50. Similarly, since the second valve 46 (see FIG. 2) is positioned proximate to the second leg 52, the air entering via the second valve 46 (see FIG. 2) enters the first (e.g., lower) portion of the air channel $\mathbf{36}_1$ proximate to the second leg 52. The air flows in the first (e.g., lower) portion of the air channel $\mathbf{36}_1$ along the path 82 in a direction, which is indicated by the arrow, from the second leg 52 toward the first leg 50 of the plate e.g., from the second valve 46 (see FIG. 2) toward the first valve 44 (see FIG. 2)). As discussed in more detail below, a portion of the air continues to flow along the path 82 in a direction, which is indicated by the arrow, from first valve 44 (see FIG. 2) toward the plate aperture 76 at the end 80 of the first leg 50.

A first portion of the air entering the first (e.g., lower) portion of the air channel $\mathbf{36}_1$ (via the first and second valves 44, 46 (see FIG. 2), respectively) flows along the path 82 and past the end 80 of the first leg 50 before being fluidly communicated, via the plate aperture 76, from the first (e.g., lower) portion of the air channel $\mathbf{36}_1$ along the first face 26 (e.g., lower face) of the plate 22 to the second (e.g., upper) portion of the air channel $\mathbf{36}_2$ along the second face 32 (e.g., upper face) of the plate 22. For example, the first portion of the air is fluidly communicated from the first (e.g., lower) portion of the air channel $\mathbf{36}_1$ along the first face 26 (e.g., lower face) of the plate 22 to the second (e.g., upper) portion of the air channel $\mathbf{36}_2$ along the second face 32 (e.g., upper face) of the plate 22 via the plate aperture 76.

Additional portions of the air entering the first (e.g., lower) portion of the air channel $\mathbf{36}_1$ (via the first and second valves 44, 46 (see FIG. 2), respectively) flow along the path 82 and are fluidly communicated from the first (e.g., lower) portion of the air channel $\mathbf{36}_1$ along the first face 26 (e.g., lower face) of the plate 22 to the second (e.g., upper) portion of the air channel $\mathbf{36}_2$ along the second face 32 (e.g., upper face) of the plate 22 via at least one of the divider apertures 70. For example, a second portion of the air, which is illustrated by arrow 82*a*, is fluidly communicated from the first (e.g., lower) portion of the air channel $\mathbf{36}_1$ along the first face 26 (e.g., lower face) to the second (e.g., upper) portion of the air channel $\mathbf{36}_2$ along the second face 32 (e.g., upper face) of the plate 22 via the divider aperture 70*a*; a third portion of the air, which is illustrated by arrow 82*b*, is fluidly communicated from the first (e.g., lower) portion of the air channel $\mathbf{36}_1$ along the first face 26 (e.g., lower face) to the second (e.g., upper) portion of the air channel $\mathbf{36}_2$ along the second face 32 (e.g., upper face) of the plate 22 via the divider aperture 70*b*; and a fourth portion of the air, which is illustrated by arrow 82*c*, is fluidly communicated from the first (e.g., lower) portion of the air channel $\mathbf{36}_1$ along the first face 26 (e.g., lower face) to the second (e.g., upper) portion of the air channel $\mathbf{36}_2$ along the second face 32 (e.g., upper face) of the plate 22 via the divider aperture 70*c*. The divider apertures 70 are positioned before the end 80 of the first leg 50 along the airflow path 82.

Once the air is communicated to the second (e.g., upper) portion of the air channel $\mathbf{36}_2$ along the second face 32 (e.g., upper face) of the plate 22, the first portion of the air encounters the additional portions of the air on the second face 56 of the first leg 50. Mixing of the first portion of the air with the additional portions of the air on the second face 56 of the first leg 50 reduces the air turbulence and pressure fluctuations of the air in the first (e.g., lower) portion of the air channel $\mathbf{36}_1$ along the first face 54 of the first leg 50 that is proximate to and impacts the first valve 44. The air then continues to flow along the path 82 which, along the second face 32 (e.g., upper face) of the plate 22, is from the first leg 50 toward the second leg 52. The air is discharged from the second portion 20 (e.g., upper portion) of the compressor head 14 proximate the end of the path 82. Since the air channel 36 is adjacent to the cooling channel 40, extending the path 82 of the air through the first and second portions of the air channel $\mathbf{36}_{1.2}$ extends a time the air passes, and is cooled by, the adjacent walls $\mathbf{42}_{1.2}$ of the first and second portions of the cooling channel $\mathbf{40}_{1.2}$.

With reference to FIGS. 1-3, providing the at least one divider aperture 70 for the air traveling along the path 82 in the first (e.g., lower) portion of the air channel $\mathbf{36}_1$ along with the plate aperture 76 reduces at least one of an airflow turbulence and pressure fluctuation proximate (e.g., above) the first valve 44 as air travels through the first (e.g., lower) portion of the air channel $\mathbf{36}_1$. Airflow turbulence and pressure fluctuation proximate the first valve 44 may impact the flexible portion of the first valve 44 (e.g., the reed portion of a reed valve) to flex in a manner to shorten a life of the flexible portion (e.g., the reed portion). For example, the airflow turbulence and pressure fluctuation may cause the flexible portion of the first valve 44 to flex in a "wave" form where one portion of the flexible portion (e.g., the reed portion) is pulled up away from the first (e.g., lower) portion 16 of the compressor head 14 while another portion of the flexible portion (e.g., the reed portion) is pushed down toward the first (e.g., lower) portion 16 of the compressor head 14. Since flexible portions of a reed valve are negatively impacted by such uneven structural stresses, it is desirable to reduce at least one of airflow turbulence and pressure fluctuations proximate to the first valve 44.

Figure 5A:
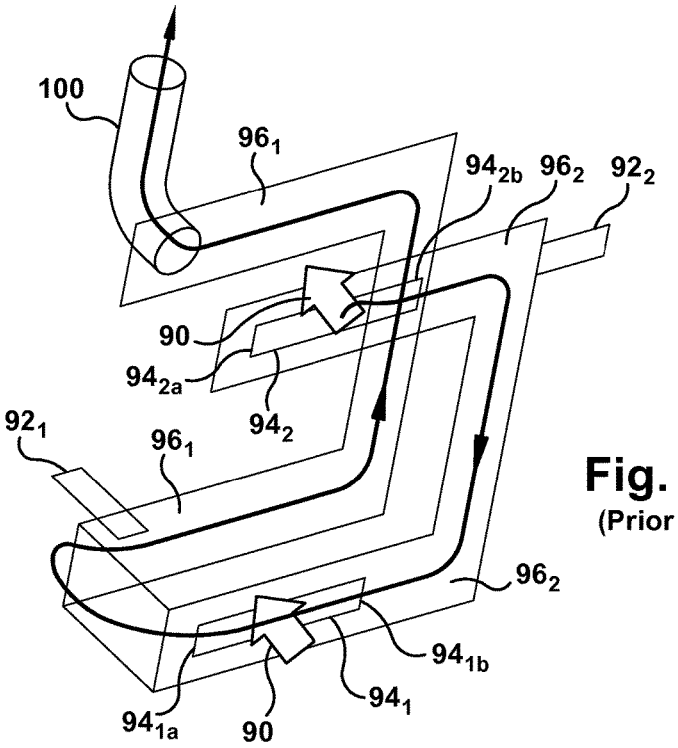
Fig. 5A (Prior Art)
FIG. 5A illustrates a sketch showing airflow in a prior art compressor head having a divider without any divider apertures.
Figure 5B:
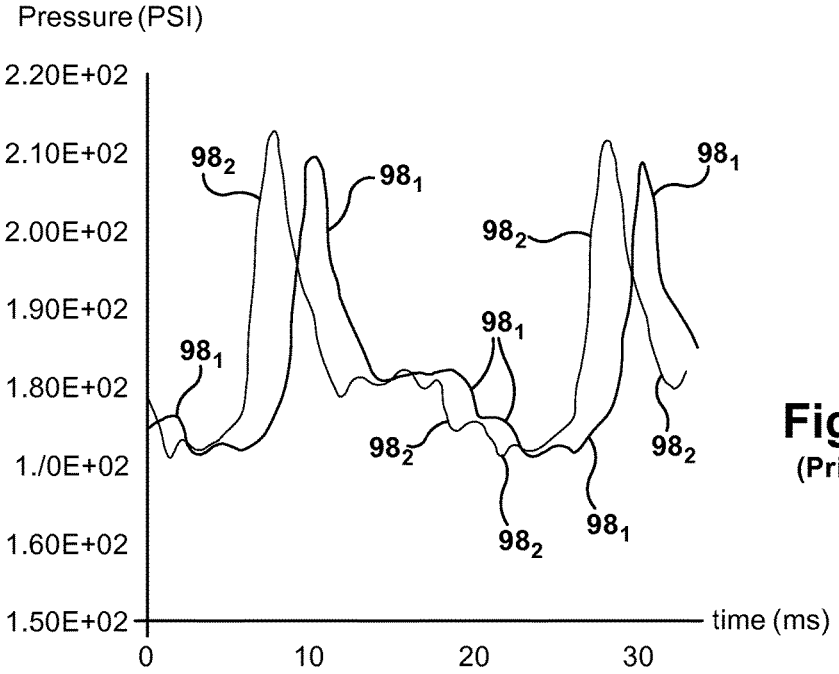
Fig. 5B (Prior Art)
FIG. 5B illustrates graphs of pressure versus time for the compressor head of FIG. 5A.

With reference to FIGS. 5A and 5B, a sketch is shown illustrating airflow 90 in a compressor head having a divider without any divider apertures. A first pressure sensor $\mathbf{92}_1$ is positioned in an upper air channel $\mathbf{96}_1$ proximate a first valve $\mathbf{94}_1$, and a second pressure sensor $\mathbf{92}_2$ is positioned in a lower air channel $\mathbf{96}_2$ proximate a second valve $\mathbf{94}_2$. Pressure (e.g., pounds per square inch (psi)) at the first pressure sensor $\mathbf{92}_1$ versus time e.g., milli-seconds (ms)) is illustrated as a graph $\mathbf{98}_1$. Similarly, pressure (e.g., psi) at the second pressure sensor $\mathbf{92}_2$ versus time (e.g., ms) is illustrated as a graph $\mathbf{98}_2$. Since air entering the lower air channel $\mathbf{96}_1$ via the second valve $\mathbf{94}_2$ travels past the first valve $\mathbf{94}_1$ before being communicated to the upper air channel $\mathbf{96}_2$ (and exiting via a port 100) while the air entering the lower air channel $\mathbf{96}_1$ via the first valve $\mathbf{94}_1$ does not travel past the second valve $\mathbf{94}_2$ before being communicated to the upper air channel $\mathbf{96}_2$, the pressure across the second valve $\mathbf{94}_2$ (and the pressure difference between points $\mathbf{94}_{2a}$, $\mathbf{94}_{2b}$) is assumed to be substantially constant. In that regard, the pressure across the second valve $\mathbf{94}_2$ is approximated to be the pressure at the second pressure sensor $\mathbf{92}_2$, and the pressure difference between points $\mathbf{94}_{2a}$, $\mathbf{94}_{2b}$ is assumed to be about zero (0). On the other hand, since air entering the lower air channel $\mathbf{96}_1$ via both the first and second valves $\mathbf{94}_1$, $\mathbf{94}_2$, travels past the first valve $\mathbf{94}_1$ before being communicated to the upper air channel $\mathbf{96}_2$, the pressure across the first valve $\mathbf{94}_1$ (and the pressure difference between points $\mathbf{94}_{1a}$, $\mathbf{94}_{1b}$) is assumed to fluctuate. In that regard, the pressure across the first valve $\mathbf{94}_1$ (e.g., the pressure difference between points $\mathbf{94}_{1a}$, $\mathbf{94}_{1b}$) is approximated to be the pressure difference between the first and second pressure sensors $\mathbf{92}_1$,$\mathbf{92}_2$. With reference again to FIGS. 1-3, it is understood that the at least one of airflow turbulence and pressure fluctuation proximate (e.g., above) the first valve 44 is reduced because of the ability of a portion of the air traveling along the path 82 to bypass the first valve 44 as air travels through the first (e.g., lower) portion of the air channel $\mathbf{36}_1$.

The respective positions of the at least one divider aperture 70 relative to the first valve 44 also affects the turbulence and air pressure proximate the first valve 44. For example, positioning at least one of the divider apertures 70 before the first valve 44 as measured along the path 82 from the second valve 46 to the first valve 44 further reduces the turbulence and air pressure fluctuations proximate the first valve 44.

As discussed above, the at least one divider aperture 70 and/or the respective positions of the at least one divider aperture 70 relative to the first valve 44 act as means for directing air between the first and second portions $\mathbf{36}_1$, $\mathbf{36}_1$, respectively, of the air channel 36. In addition, the at least one divider aperture 70 and/or the respective positions of the at least one divider aperture 70 relative to the first valve 44 act as a means for reducing a turbulence of the air proximate to the first valve 44, reducing a structural stress on the first valve 44, and extending a useful life of the first valve 44.

Performance was compared between a compressor head 14 including a divider 34 having three (3) divider apertures 70*a*, 70*b*, 70*c*, as described herein, and a compressor head including a divider without any divider apertures. Air discharged at the end of the path 82 from the compressor head 14 including a divider 34 having three (3) divider apertures 70*a*, 70*b*, 70*c* had a discharge air temperature of about 300° F. at 3000 RPM. Air discharged from a compressor head including a divider without any divider apertures also had a discharge air temperature of about 300° F. at 3000 RPM. Therefore, the performance of the compressor head 14 including a divider 34 having three (3) divider apertures 70*a*, 70*b*, 70*c* did not have a significant rise in temperature of the discharge air when compared with a compressor head including a divider without any divider apertures. Furthermore, the first valve 44 (e.g., reed valve) proximate the plate aperture 76 in the compressor head 14 including a divider 34 having three (3) divider apertures 70*a*, 70*b*, 70*c* had an average useful life (e.g., before failure) that was about 40 times longer when compared with a compressor head including a divider without any divider apertures.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A compressor head, comprising:
a first portion, including:
a first valve;
a second valve;
a lower portion of an air channel, the first and second valves communicating air into the lower portion of the air channel; and
a first portion of a cooling channel adjacent the lower portion of the air channel;
a second portion, including:
an upper portion of the air channel; and
a second portion of the cooling channel adjacent the upper portion of the air channel; and
a baffle directing the air between the lower portion of the air channel and the upper portion of the air channel, the baffle including:
a first leg, extending between the lower portion of the air channel and the upper portion of the air channel, positioned proximate to the first valve, a first portion of the air being communicated from the lower portion of the air channel to the upper portion of the air channel beyond an end of the first leg;
a second leg, extending between the lower portion of the air channel and the upper portion of the air channel, positioned proximate to the second valve;
a baffle aperture, along a fluid path before the first valve for the air flowing from the second leg to the first leg, communicating a second portion of the air from the lower portion of the air channel to the upper portion of the air channel; and
at least one additional baffle aperture in the first leg, proximate to the first valve and after the baffle aperture along the fluid path of the air flowing from the second leg to the first leg, communicating respective additional portions of the air from the lower portion of the air channel to the upper portion of the air channel;
the communication of the first and additional portions of the air along with the communication of the second portion of the air creating a reduction in at least one of airflow turbulence and pressure fluctuation proximate the first valve.

2. The compressor head as set forth in claim 1, wherein:
the baffle aperture and each of the additional baffle apertures are substantially aligned along an axis of the first leg.

3. The compressor head as set forth in claim 1, wherein:
the first leg is substantially parallel to the second leg.

4. The compressor head as set forth in claim 1, wherein:
the baffle extends a path of the air along a wall adjacent to the cooling channel.

5. The compressor head as set forth in claim 4, wherein:
the extended path of the air along the wall adjacent to the cooling channel results in a reduced temperature of the air.

6. The compressor head as set forth in claim 1, further including:
a plate between the first portion of the compressor head and the second portion of the compressor head; and
a plate aperture beyond the end of the first leg;
wherein the lower portion of the air is communicated from the first portion of the air channel to the upper portion of the air channel via the plate aperture.

7. The compressor head as set forth in claim 6, wherein:
the baffle is secured to the plate.

8. The compressor head as set forth in claim 1, wherein:
the reduction in at least one of the airflow turbulence and the pressure fluctuation reduces a structural stress on the first valve.

9. The compressor head as set forth in claim 8, wherein:
the first valve is a reed valve; and
the reduction in at least one of the airflow turbulence and the pressure fluctuation proximate the reed valve reduces the structural stress on the reed valve.

10. The compressor head as set forth in claim 9, wherein:
the reduction in at least one of the airflow turbulence and the pressure fluctuation proximate to the reed valve extends an average useful life of the reed valve.

11. A baffle for directing air within a compressor head, the baffle including:
a first leg extending substantially parallel to a first valve of the compressor head, the first leg including:
a first face facing toward the first valve; and
a second face facing away from the first valve;
a second leg extending substantially parallel to a second valve of the compressor head, the second leg including:
a first face facing toward the second valve; and
a second face facing away from the second valve; and
an aperture in the first leg, along a fluid path before the first valve for the air communicated from the second leg to the first leg along the first faces, a first portion of the air communicated from the second leg to the first leg along the first faces passing the aperture and being communicated to the second face of the first leg past an end of the first leg, and a second portion of the air communicated from the second leg to the first leg along the first faces being communicated to the second face of the first leg via the aperture, communication of the second portion of the air via the aperture reduces at least one of airflow turbulence and pressure fluctuation of the air impacting the first valve.

12. The baffle for directing air within the compressor head as set forth in claim 11, wherein:
the first portion of the air encounters the second portion of the air on the second face of the first leg.

13. The baffle for directing air within the compressor head as set forth in claim 11, further including:
at least one additional aperture in the first leg;
wherein a third portion of the air communicated from the second leg to the first leg along the first faces is communicated to the second face of the first leg via the at least one additional aperture.

14. The baffle for directing air within the compressor head as set forth in claim 13, wherein:
there are two of the at least one additional apertures.

15. A method for communicating air within a compressor head, the method comprising:
receiving air into a first portion of the compressor head via a first valve and a second valve; and
reducing at least one of airflow turbulence and pressure fluctuation proximate the first valve, including:
directing the air in the first portion of the compressor head along a fluid path from the second valve toward the first valve;
directing a first portion of the air from the first portion of the compressor head to a second portion of the compressor head at a first position, along the fluid path, that is beyond a divider between the first portion of the compressor head and the second portion of the compressor head; and directing a second portion of the air from the first portion of the compressor head to the second portion of the compressor head at a second position along the fluid path that is proximate the first valve and before the first position by passing the second portion of the air through the divider at the second position.

16. The method for communicating air within the compressor head as set forth in claim 15, wherein the step of passing the second portion of the air through the divider includes:

passing the second portion of the air through the divider at the second position that is one of i) across and ii) before the first valve along the fluid path.

17. The method for communicating air within the compressor head as set forth in claim 15, further including:

directing a third portion of the air from the first portion of the compressor head to the second portion of the compressor head at a third position, along the fluid path, that is proximate the first valve and before the first position.

18. The method for communicating air within the compressor head as set forth in claim 17, further including:

passing the second portion of the air through the divider at the second position that is one of across and before the first valve; and the step of directing the third portion of the air includes:

passing the third portion of the air through the divider at the third position that is one of i) across and ii) before the first valve along the fluid path.

* * * * *